US009294831B2

(12) United States Patent
Tan et al.

(10) Patent No.: US 9,294,831 B2
(45) Date of Patent: Mar. 22, 2016

(54) IN-EAR EARPIECE AND EXPANSION ADAPTOR

(71) Applicant: Sennheiser electronic GmbH & Co. KG, Wedemark (DE)

(72) Inventors: Chee Keong Tan, Singapore (SG); Yuen Shen Wong, Singapore (SG)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 14/830,074

(22) Filed: Aug. 19, 2015

(65) Prior Publication Data

US 2015/0358711 A1 Dec. 10, 2015

Related U.S. Application Data

(63) Continuation of application No. 14/508,235, filed on Oct. 7, 2014, now Pat. No. 9,143,855, which is a continuation of application No. 13/063,915, filed as application No. PCT/EP2009/061973 on Sep. 15, 2009, now Pat. No. 8,897,480.

(30) Foreign Application Priority Data

Sep. 16, 2008 (DE) ..... 10 2008 047 520

(51) Int. Cl.
*H04R 25/00* (2006.01)
*H04R 1/10* (2006.01)
*H04R 1/02* (2006.01)

(52) U.S. Cl.
CPC ..... *H04R 1/105* (2013.01); *H04R 1/1016* (2013.01); *H04R 1/1058* (2013.01); *H04R 1/02* (2013.01)

(58) Field of Classification Search
CPC .... H04R 1/1016; H04R 1/105; H04R 1/1058; H04R 1/10; H04R 1/1091; H04R 1/1066; H04R 25/60; H04R 25/652; H04R 2201/10; H04R 2201/105; H04R 2225/025; H04R 2225/63; A61F 11/08
See application file for complete search history.

(56) References Cited

U.S. PATENT DOCUMENTS

| | | | |
|---|---|---|---|
| 1,668,910 | A | 5/1928 | Jones |
| 5,712,453 | A | 1/1998 | Bungardt et al. |
| 6,810,987 | B1 | 11/2004 | DeKalb |

(Continued)

FOREIGN PATENT DOCUMENTS

| | | | |
|---|---|---|---|
| DE | 29718483 | U1 | 4/1999 |
| DE | 10227450 | A1 | 1/2004 |

(Continued)

OTHER PUBLICATIONS

International Search Report for Application No. PCT/EP2009/061973 mailed on Dec. 10, 2009, 4 pages.

(Continued)

*Primary Examiner* — Matthew Eason
(74) *Attorney, Agent, or Firm* — Kilpatrick Townsend & Stockton LLP

(57) ABSTRACT

There is provided an in-ear earphone having a housing for receiving an electroacoustic transducer and an expansion adaptor unit which is coupled to the housing of the in-ear earphone. The expansion adaptor unit has an expansion unit with an upper portion having a curvature for fitting into a crus inferius anthelicis, an anti-helix and/or a concha of an ear of a user. The expansion adaptor unit further has at least one coupling element for coupling the upper portion to the housing of the in-ear earphone, wherein the expansion unit has at least two flexible legs as coupling elements, wherein one leg is coupled to a first end of the upper portion and a second leg is coupled to a second end of the upper portion.

15 Claims, 2 Drawing Sheets

(56) References Cited

U.S. PATENT DOCUMENTS

| | | | | |
|---|---|---|---|---|
| 8,897,480 | B2 | 11/2014 | Tan et al. | |
| 2003/0174853 | A1 * | 9/2003 | Howes | H04R 1/083 381/370 |
| 2005/0147269 | A1 | 7/2005 | Oliveira et al. | |
| 2006/0177080 | A1 | 8/2006 | Smith | |

FOREIGN PATENT DOCUMENTS

| | | | |
|---|---|---|---|
| DE | 10200401098 | A1 | 9/2005 |
| WO | 2010/031775 | A1 | 3/2010 |

OTHER PUBLICATIONS

Written Opinion for Application No. PCT/EP2009/061973 mailed on Dec. 10, 2009, 5 pages.

Non-Final Office Action of Nov. 8, 2012 for U.S. Appl. No. 13/063,915, 8 pages.

Final Office Action of Apr. 18, 2013 for U.S. Appl. No. 13/063,915, 9 pages.

Non-Final Office Action of Nov. 12, 2013 for U.S. Appl. No. 13/063,915, 16 pages.

Final Office Action of Jun. 10, 2014 for U.S. Appl. No. 13/063,915, 13 pages.

Notice of Allowance of Aug. 26, 2014 for U.S. Appl. No. 13/063,915, 5 pages.

Non-Final Office Action of Dec. 16, 2014 for U.S. Appl. No. 14/508,235, 16 pages.

Notice of Allowance of May 20, 2015 for U.S. Appl. No. 14/508,235, 9 pages.

* cited by examiner

IN-EAR EARPIECE AND EXPANSION ADAPTOR

CROSS-REFERENCE TO RELATED APPLICATIONS

This application is a Continuation of U.S. application Ser. No. 14/508,235, filed Oct. 7, 2014, which is a Continuation of U.S. application Ser. No. 13/063,915, filed Jun. 23, 2011, which is a U.S. National Stage of PCT Application No. PCT/EP2009/061973, filed Sep. 15, 2009, which claims the benefit of German Application No. 10 2008 047 520.3, filed Sep. 16, 2008, each of which is incorporated by reference herein for all purposes.

BACKGROUND

The present invention concerns an in-ear earphone and an expansion adaptor.

In-ear earphones have become highly popular in recent years as they are increasingly used together with MP3 players or media players. In-ear earphones however are often not suitable for being worn in sport or when involving vigorous activities as those in-ear earphones have a tendency to fall out of the concha of a user.

U.S. Pat. No. 5,712,453 shows an in-ear earphone with an expansion adaptor which has an arm which can be anchored in the concha.

U.S. Pat. No. 1,668,910 shows an in-ear earphone having an expansion adaptor which is in the form of a question mark.

DE 10 2004 010 198 A1 shows an in-ear earphone having a support element which can be anchored in the concha of a listener.

U.S. Pat. No. 6,810,987 B1 shows an in-ear earphone having a support element which can be anchored in the concha of a user.

DE 102 27 450 A1 shows a headset having a stiff loop for bearing in concha. In that case only one end of the loop is fixed to the in-ear earphone.

DE 297 18 483 U1 shows a fixing unit for fixing otological devices in an ear of a user. In that case the fixing unit can have two loops which are anchored in the one hand in the concha and on the other hand in the region of the antitragus.

US No 2003/0174853 A1 shows a headset having an expansion adaptor, wherein the expansion adaptor is fixed with its first end to the headset and the second end is fixed in a concha.

Therefore an object of the present invention is to provide an in-ear earphone which can be used when playing sport or in other vigorous or lively activities.

SUMMARY

That object is attained by an in-ear earphone as set forth in the claims.

Therefore there is provided an in-ear earphone having a housing for receiving an electroacoustic transducer and an expansion adaptor unit which is coupled to the housing of the in-ear earphone. The expansion adaptor unit has an expansion unit with an upper portion having a curvature for fitting into a crus inferius anthelicis, an anti-helix and/or a concha of an ear of a user. The expansion adaptor unit further has at least one coupling element for coupling the upper portion to the housing of the in-ear earphone. The expansion unit has at least two flexible legs as coupling elements. One leg is coupled to the first end of the upper portion and a second leg is coupled to a second end of the upper portion.

The invention also concerns an expansion adaptor for an in-ear earphone. The expansion adaptor has a ring unit for fixing to a housing of an in-ear earphone. The expansion adaptor further has an expansion unit having an upper portion with a curvature for bending or fitting to the crus inferius anthelicis, the anti-helix and the concha of an ear of a user. The expansion unit further has at least one coupling element for coupling the upper portion to the ring.

In an aspect of the invention the expansion unit has at least two legs as coupling elements. One leg is coupled to a first end of the upper portion and a second leg is coupled to the second end of the lower portion.

The invention further concerns an expansion adaptor with a ring for coupling to a housing of an in-ear earphone and an expansion unit substantially in the form of a shark fin. The expansion unit has a curvature which fits into a crus inferius anthelicis, an anti-helix and/or a concha of an ear of a user.

The invention concerns the idea of using an expansion adaptor or an expansion unit which is made for example from a soft rubber which permits bending and fitment in different ears. Such an expansion unit can be fixed to the housing of the in-ear earphone, thereby permitting a secure snug fit in the ear of the user, in particular at the crus inferius anthelicis, the anti-helix and the concha.

In accordance with an aspect of the invention the expansion unit can be interchangeable.

Further aspects of the invention are described in the appendant claims.

BRIEF DESCRIPTION OF THE DRAWINGS

Embodiments by way of example and advantages of the invention are described in greater detail hereinafter with reference to the drawings.

DETAILED DESCRIPTION

Figure 1A:
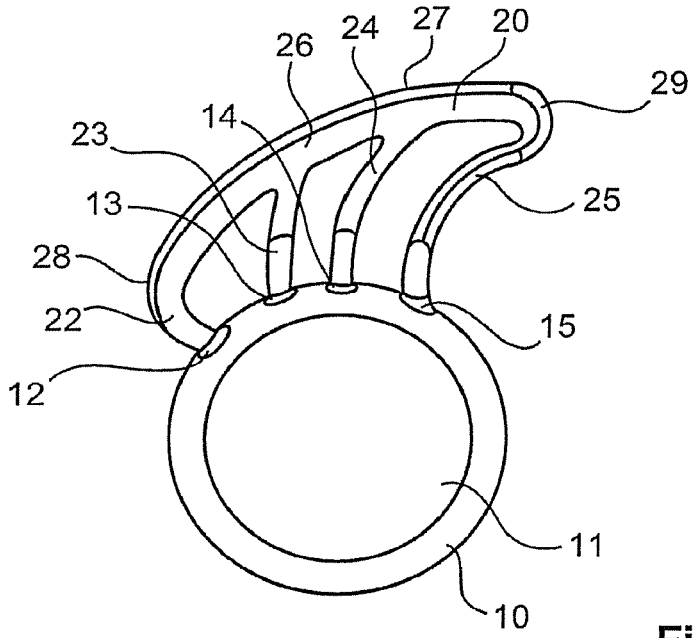
FIGS. 1A and 1B show diagrammatic views of an expansion adaptor according to a first embodiment.
Figure 1B:
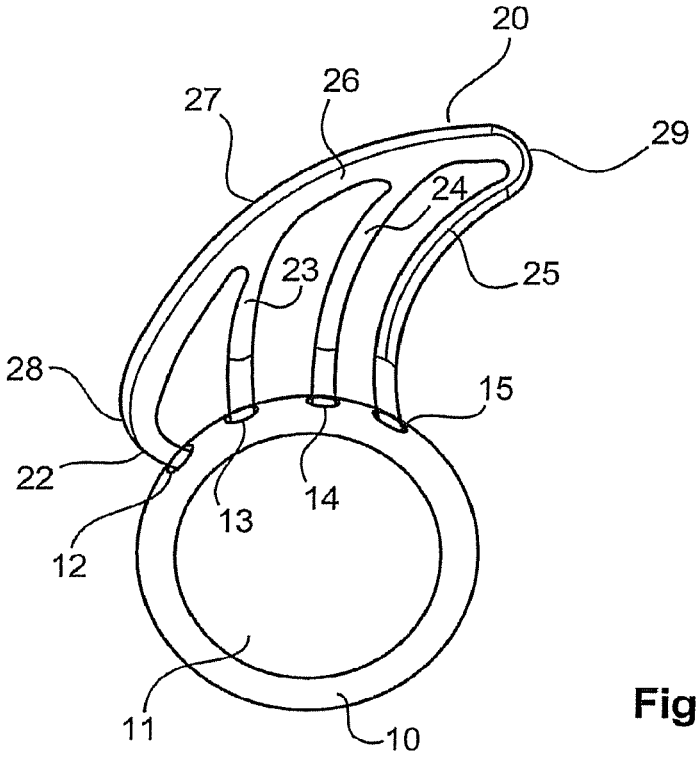

FIGS. 1A and 1B show diagrammatic views of an expansion adaptor according to a first embodiment. The expansion adaptor can be fixed interchangeably or removably to a housing of an in-ear earphone. The expansion adaptor or the expansion adaptor unit has a ring 10 having a hole 11 and an expansion unit 20. The ring 10 and the hole 11 are so selected that the ring fits securely on a housing of an in-ear earphone. Thus the expansion adaptor unit can be mounted or fixed to a housing of an in-ear earphone. The expansion unit 20 is connected to the ring 10 and serves as a means for securing the expansion adaptor in an ear of a user. The expansion unit 10 has four legs 22, 23, 24 and 25 as well as an upper and a lower portion 26 having a given curvature. The upper portion 26 can be placed on the crus inferius anthelicis, the anti-helix and the concha of an ear and has a first end 28 and a second end 29. The first end 28 of the upper portion 26 is coupled to the first leg 22 of the expansion unit 20 while the fourth leg 25 is coupled to the second end 29 of the upper portion 26. The first leg 22 of the expansion unit 20 is coupled at a first connecting point 12, the second leg 23 is coupled to a second connecting point 13, the third leg 24 is coupled to a third connecting point 14 and the fourth leg 24 is coupled to a fourth connecting point 15. The first, second, third and fourth connecting points 12, 13, 14 and 15 are provided on the ring 10. The ring 10 and the expansion unit 20 can be produced in one piece or in the form of one portion. Alternatively the expansion unit 20 can be provided on or fixed to the ring 10. The ring 10 can be in the form of a closed or open ring.

Although the first, second, third and fourth legs 22-25 have been shown with a given curvature, those legs can also be implemented in the form of straight lines. It should be pointed out that, although four different legs 22-25 have been shown in FIGS. 1A and 1B, the expansion unit 20 can be implemented with more than or fewer than those four legs. The expansion unit 20 can also be implemented without legs for example in the form of a solid body. The curvature 27 of the upper portion 26 is selected so that it fits (securely) in a crus inferius anthelicis, an anti-helix and the concha of an ear of a user.

Although hereinbefore the material of the expansion unit 20 and in particular the material of the four legs have been described as one material, the expansion unit can be implemented, wherein the upper portion 26 can be made from a different material from the legs 22-25.

An in-ear earphone can be securely and comfortably fitted in almost any ear of a user by means of the expansion adaptor according to the first embodiment. Thus it is possible to provide an expansion adaptor which has a unitary size (one size fits all) or which fits into all ears.

The material of the expansion adaptor according to the first embodiment is preferably soft rubber. Alternatively it is possible to use other materials which are sufficiently flexible and which allow comfortable and secure use of the expansion adaptor in the ears of the users.

FIGS. 2A through 2E show a plan view, a front view, a side view, an isometric view A and an isometric view B of an in-ear earphone in accordance with a second embodiment. Here in the second embodiment the expansion adaptor as shown in FIGS. 1A and 1B is a part of the housing of an in-ear earphone, for example a constituent part of the in-ear earphone. The housing 50 of the in-ear earphone is connected to the expansion adaptor. As can be seen from FIGS. 2B, 2C and 2E the expansion adaptor of the second embodiment substantially corresponds to the expansion adaptor of the first embodiment. Thus the expansion unit 20 has four legs 22-25 connected to the ring 10 at their first ends and connected at their second ends to the upper portion 26. The upper portion 26 has a first and a second end 28, 29, wherein the first end 28 is coupled to the first leg 22 and the second end 29 is coupled to the fourth leg 25.

The expansion unit 20 of the first or second embodiment has an upper portion 26 having a curvature. The upper portion 26 having the curvature is connected to the ring 10 by at least one leg 22-25. The legs are preferably made from a soft rubber. The upper portion 26 with the curvature is so selected that it fits into the crus inferius anthelicis, the anti-helix and the concha of a user, wherein the second end 29 can bear against the crus inferius anthelicis and the first end 28 can lie in the concha of the user. The upper portion 26 with the curvature can be fitted into shapes of different complexity of an ear of a user by means of the flexible legs 22-25. Particularly as the legs are flexible the upper portion 26 can bend if that is required. If the curvature of the crus inferius anthelicis, the anti-helix and the concha of a user is great, then the curvature of the upper portion 26 can be adapted to such a curvature as the flexible legs 22-25 will correspondingly bend.

As shown in FIGS. 1A through 2D the expansion adaptor is substantially in the shape of a shark fin.

The expansion adaptor of the first or second embodiment can for example have a spring stiffness, wherein the spring stiffness in a vertical direction (as indicated by the arrow F1 in FIG. 2B) can be between 0.05 and 0.6 N/mm. Preferably the spring stiffness here is of a value of 0.3 N/mm.

The expansion adaptor can further have a spring stiffness in the horizontal direction (as indicated by the arrow F2 in FIG. 2C) of between 0.02 and 0.4 N/mm. Preferably that spring stiffness can be of a value of 0.08 N/mm.

Figure 2A:
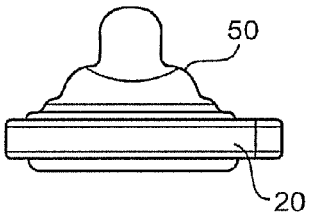
FIGS. 2A through 2E show a plan view, a front view, a side view, an isometric view A and an isometric view B of an in-ear earphone according to a second embodiment.
Figure 2B:
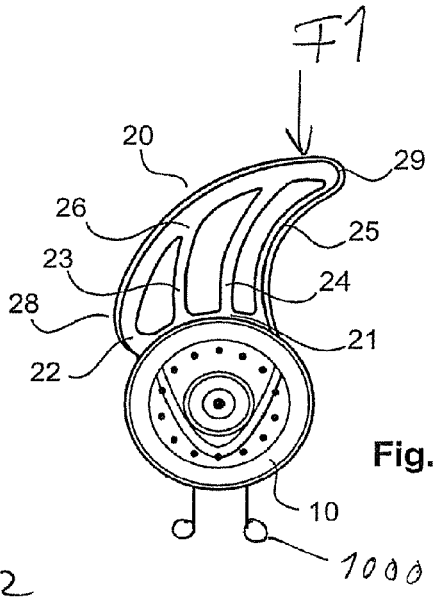
Figure 2C:
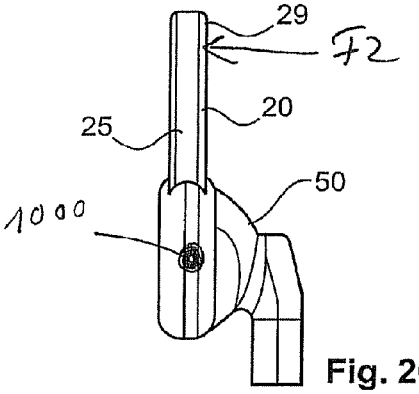
Figure 2D:
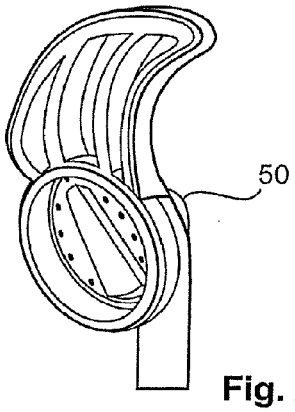
Figure 2E:
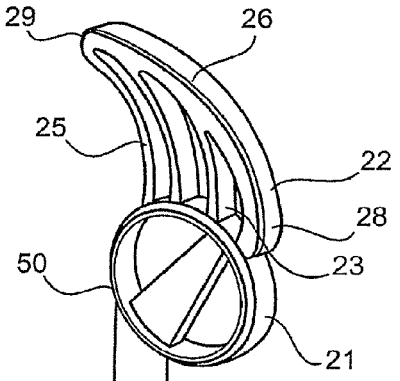

The spring stiffness F1 was ascertained by the in-ear earphone being clamped at the clamping points 1000 and by a pressure being applied from above at the location of the arrow F1 in FIG. 2B. In that procedure the force was detected with a stretch of 4 mm. In particular five measurements were made, wherein the measured force reached 0.507; 0.508; 0.514; 0.504; and 0.507 N.

In regard to the second spring stiffness the earphone or the expansion adaptor was also clamped or gripped at the clamping points 1000 and a force was ascertained at a stretch of 4 mm. In that procedure five measurements were made and pressures of 0.197; 0.195; 0.200; 0.194 and 0.201 N were determined.

In the measurements of spring stiffness the force was detected at a deflection of 4 mm.

What is claimed is:

1. An in-ear earphone comprising:

a housing for receiving an electroacoustic transducer; and an expansion adaptor unit coupled to the housing of the in-ear earphone, wherein the expansion adaptor unit has an expansion unit having a substantially shark fin shape that includes an upper portion with a curvature for fitting in a crus inferius anthelicis, in an anti-helix, and in a concha of an ear of a user, and one or more flexible coupling elements for coupling the upper portion to the housing of the in-ear earphone, wherein the upper portion has a first end and a second end and one of the one or more flexible coupling elements is coupled to the second end, the upper portion having a substantially convex shape beginning at the second end and extending toward the housing, and the one of the one or more flexible coupling elements having a substantially concave shape beginning at a coupling point with the second end and extending toward the housing, wherein the concave shape of the one of the one or more flexible coupling elements has a radius of curvature that is smaller than a radius of curvature of the convex shape of the upper portion, and wherein the curvature of the upper portion is selected to fit in the crus inferius anthelicis and the anti-helix of the ear of the user, and the second end of the upper portion bears against the crus inferius anthelicis, the second end forming a tip for fitting into a volume formed on three sides by a crus helicis, a cymba conchae and a crus inferius anthelicis of the ear of the user.

2. The in-ear earphone of claim 1 wherein the one of the one or more flexible coupling elements has a continuous curvature beginning at the second end and extending to a connection point.

3. The in-ear earphone of claim 1 wherein the one or more flexible coupling elements include at least two flexible coupling elements, a second flexible coupling element of the at least two flexible coupling elements coupling the first end of the upper portion to the housing.

4. The in-ear earphone of claim 1 wherein the expansion unit is flexible.

5. The in-ear earphone of claim 1 wherein the one of the one or more flexible coupling elements and the upper portion join at an acute angle at the second end.

6. An in-ear earphone comprising:

a housing for receiving an electroacoustic transducer; and an expansion adaptor unit having a ring coupled to the housing of the in-ear earphone and an expansion unit coupled to the ring, wherein the expansion unit has a substantially shark fin shape that includes an upper portion with a curvature for fitting in a crus inferius anthelicis, in an anti-helix, and in a concha of an ear of a user, and one or more flexible coupling elements for coupling the upper portion to the ring, wherein the upper portion has a first end and a second end and one of the one or more flexible coupling elements is coupled to the second end, the upper portion having a substantially convex shape beginning at the second end, and the one of the one or more flexible coupling elements having a substantially concave shape beginning at a coupling point with the second end and continuing to a first connecting point on the ring, wherein the curvature of the upper portion is selected to fit in the crus inferius anthelicis and the anti-helix of the ear of the user, and the second end of the upper portion bears against the crus inferius anthelicis, and wherein a continuous section of each of the upper portion, the second end, and the one of the one or more flexible coupling elements forms a tip that contacts sides of a volume formed by a crus helicis, a cymba conchae and a crus inferius anthelicis of the ear of the user.

7. The in-ear earphone of claim 6 wherein the concave shape of the one of the one or more flexible coupling elements has a radius of curvature that is smaller than a radius of curvature of the convex shape of the upper portion.

8. The in-ear earphone of claim 6 wherein the one or more flexible coupling elements include at least two flexible coupling elements, a second flexible coupling element of the at least two flexible coupling elements coupling the first end of the upper portion to the ring.

9. The in-ear earphone of claim 6 wherein the expansion unit is flexible.

10. The in-ear earphone of claim 6 wherein the one of the one or more flexible coupling elements and the upper portion join at an acute angle at the second end.

11. An in-ear earphone comprising:

a housing for receiving an electroacoustic transducer; and an expansion adaptor unit coupled to the housing of the in-ear earphone, wherein the expansion adaptor unit has an expansion unit having a substantially shark fin shape that includes an upper portion with a curvature for fitting in a crus inferius anthelicis, in an anti-helix, and in a concha of an ear of a user, and one or more flexible coupling elements for coupling the upper portion to the housing of the in-ear earphone, wherein the upper portion has a first end and a second end and one of the one or more flexible coupling elements is coupled to the second end, the upper portion having a substantially convex shape beginning at the second end, and the one of the one or more flexible coupling elements having a substantially concave shape beginning at a coupling point with the second end and continuing to a connecting point, wherein the curvature of the upper portion is selected to fit in the crus inferius anthelicis and the anti-helix of the ear of the user, and the second end of the upper portion bears against the crus inferius anthelicis, the second end forming a tip for fitting into a volume formed on three sides by a crus helicis, a cymba conchae and a crus inferius anthelicis of the ear of the user, and wherein when the expansion unit is placed in the ear of the user, an angle of the substantially concave shape becomes sharper allowing the tip to extend into the volume.

12. The in-ear earphone of claim 11 wherein the concave shape of the one of the one or more flexible coupling elements has a radius of curvature that is smaller than a radius of curvature of the convex shape of the upper portion.

13. The in-ear earphone of claim 11 wherein the one or more flexible coupling elements include at least two flexible coupling elements, a second flexible coupling element of the at least two flexible coupling elements coupling the first end of the upper portion to the housing.

14. The in-ear earphone of claim 11 wherein the expansion unit is flexible.

15. The in-ear earphone of claim 11 wherein the one of the one or more flexible coupling elements and the upper portion join at an acute angle at the second end.

* * * * *